US008662922B2

(12) United States Patent
Yu et al.

(10) Patent No.: US 8,662,922 B2
(45) Date of Patent: Mar. 4, 2014

(54) POWER CONNECTOR

(75) Inventors: Wang-I Yu, Jhonghe (TW); Hung-Chi Tai, Jhonghe (TW); Zhi-Qiang Rong, Taicang (CN)

(73) Assignee: Alltop Electronics (Suzhou) Co., Ltd, Taichang (CN)

( * ) Notice: Subject to any disclaimer, the term of this patent is extended or adjusted under 35 U.S.C. 154(b) by 233 days.

(21) Appl. No.: 13/109,241

(22) Filed: May 17, 2011

(65) Prior Publication Data

US 2012/0252254 A1 Oct. 4, 2012

(30) Foreign Application Priority Data

Mar. 30, 2011 (CN) ..... 2011 1 0078716

(51) Int. Cl.
*H01R 13/40* (2006.01)

(52) U.S. Cl.
USPC ..... 439/595; 439/746

(58) Field of Classification Search
USPC ..... 439/350, 595, 733.1, 871, 746, 748
See application file for complete search history.

(56) References Cited

U.S. PATENT DOCUMENTS

| | | | | | |
|---|---|---|---|---|---|
| 4,701,004 | A * | 10/1987 | Yohn | 439/871 |
| 4,979,915 | A * | 12/1990 | Pitts | 439/884 |
| 5,002,504 | A * | 3/1991 | Carlson | 439/599 |
| 6,280,250 | B1 * | 8/2001 | Ko | 439/595 |
| 6,425,780 | B1 * | 7/2002 | Muhlmichel | 439/460 |
| 6,840,822 | B1 * | 1/2005 | Hall et al. | 439/752.5 |
| 7,387,545 | B2 * | 6/2008 | Tyler et al. | 439/752 |
| 2007/0066135 | A1 * | 3/2007 | Menez | 439/595 |
| 2007/0111612 | A1 * | 5/2007 | Fabian et al. | 439/733.1 |

* cited by examiner

*Primary Examiner* — Neil Abrams
*Assistant Examiner* — Travis Chambers
(74) *Attorney, Agent, or Firm* — Sughrue Mion, PLLC

(57) ABSTRACT

A power connector adapted for electrically connecting with a cable includes an insulative housing defining a number of passageways extending therethrough and a number of contacts received in corresponding passageways. A latching arm is formed in each passageway. Each contact has a base section, a contact section extending from the base section, a retention section extending oppositely from the base section, and a side section extending perpendicularly from edges of the base section. The base section of the contact defines a latching hole receiving the latching aim of the insulative housing to thereby secure the contact in the housing.

15 Claims, 11 Drawing Sheets

POWER CONNECTOR

BACKGROUND OF THE INVENTION

1. Field of the Invention

The present invention relates to a power connector, more particularly to a power connector connecting with a cable.

2. Description of Related Art

Power connectors are widely used today. In general, power connectors can be classified into personal use and industrial use. When in personal use, power connectors can be classified as desktop connectors, laptop connectors, mobile phone connectors, consuming connectors, and other types. A conventional power connector usually includes an insulating housing and a plurality of power contacts received in the housing. The housing always forms retention structure to secure the contact within corresponding passageway thereof. However, how to increase the reliability of the contact secured in the housing is a design problem in the art.

Hence, it is desirable to design a power connector to address problems mentioned above.

BRIEF SUMMARY OF THE INVENTION

Accordingly, an object of the present invention is to provide a power connector, a contact of which can be secured within a housing.

In order to achieve the above-mentioned object, A power connector adapted for electrically connecting with a cable includes an insulative housing defining a plurality of passageways extending therethrough and a plurality of contacts received in corresponding passageways. A latching arm is formed in each of the plurality of passageway. Each contact has a base section, a contact section extending from the base section, a retention section extending oppositely from the base section, and a side section extending perpendicularly from edges of the base section. The base section of the contact defines a latching hole receiving the latching arm of the insulative housing to thereby secure the contact in the housing.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
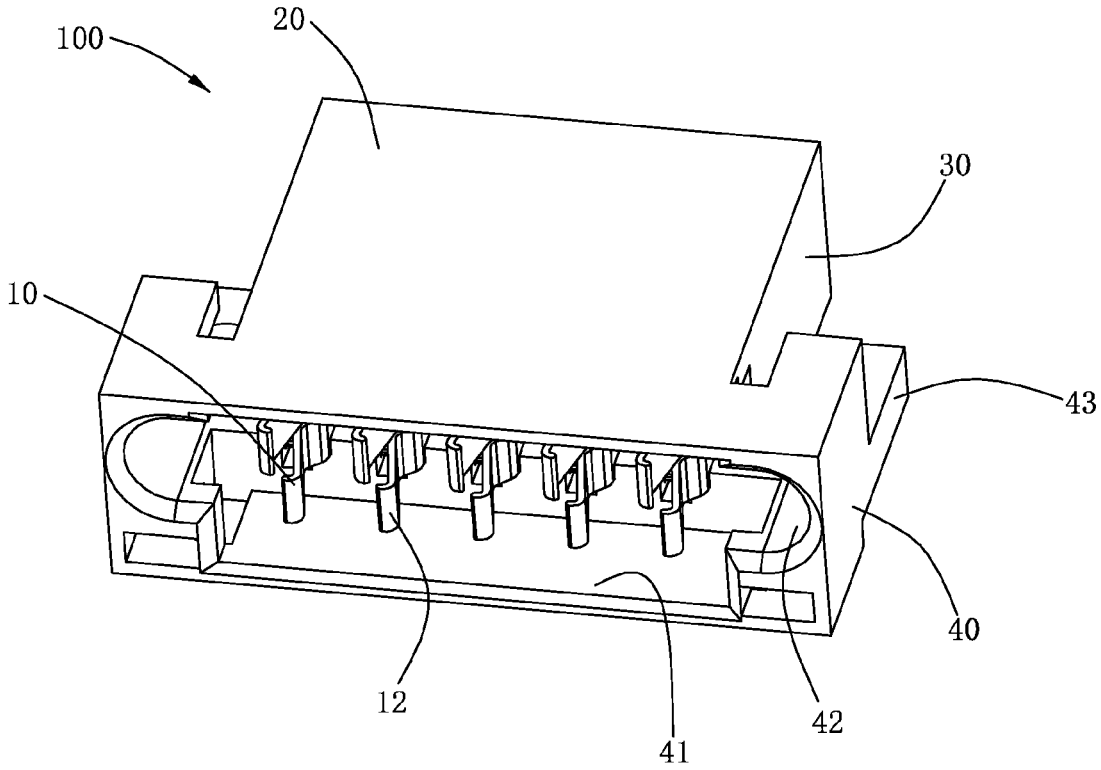
FIG. 1 is an assembled, perspective view of a power connector in accordance with a first embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
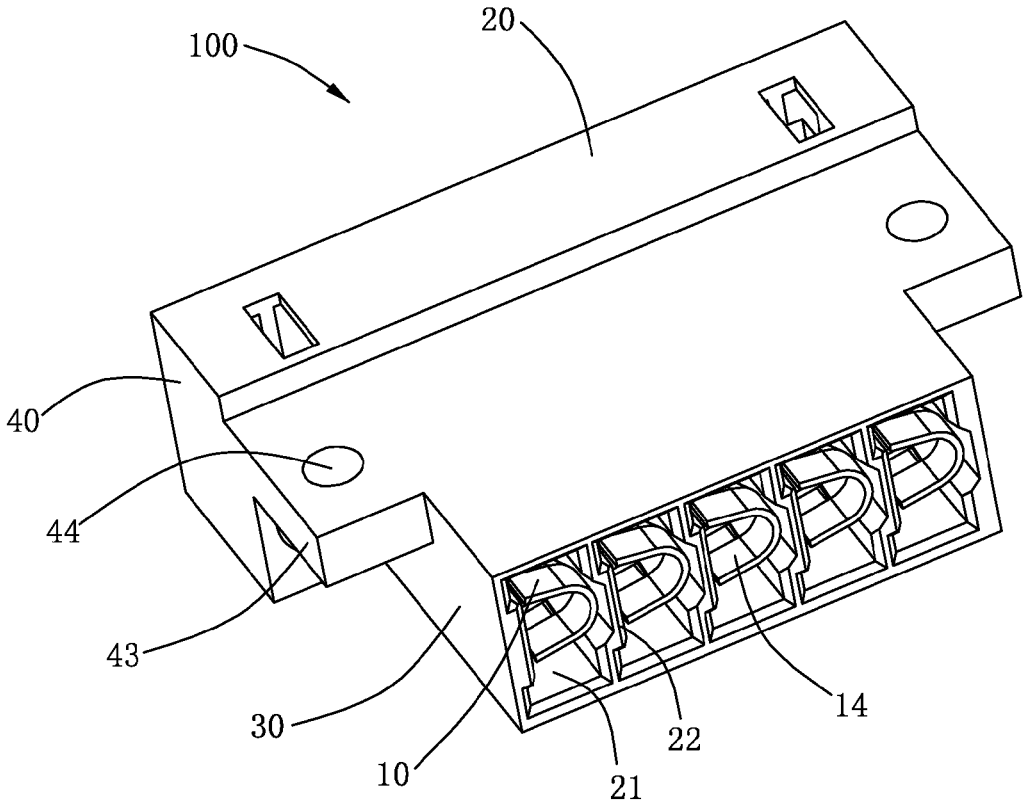
FIG. 2 is a view similar to FIG. 1 while taken from another aspect.
Figure 3:
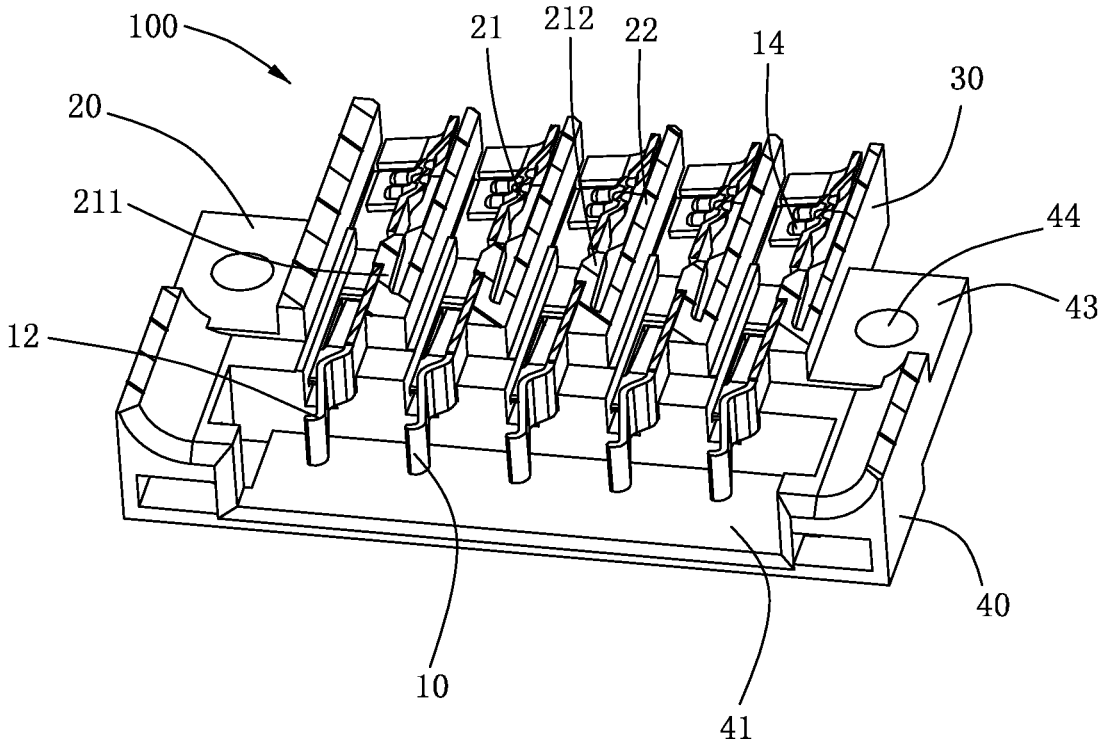
FIG. 3 is a cross-section view of the power connector shown in FIG. 1.
Figure 4:
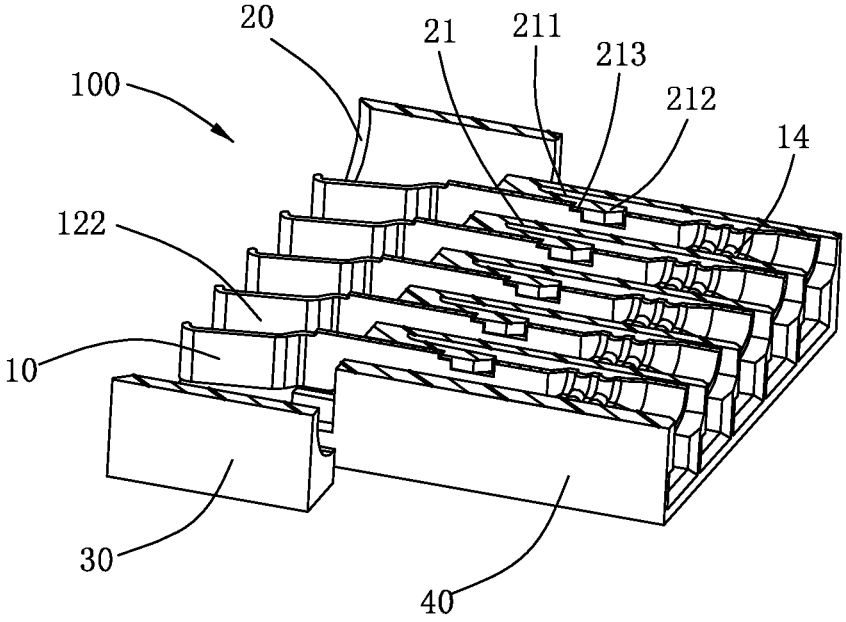
FIG. 4 is a cross-section view of the power connector shown in FIG. 2.
Figure 5:
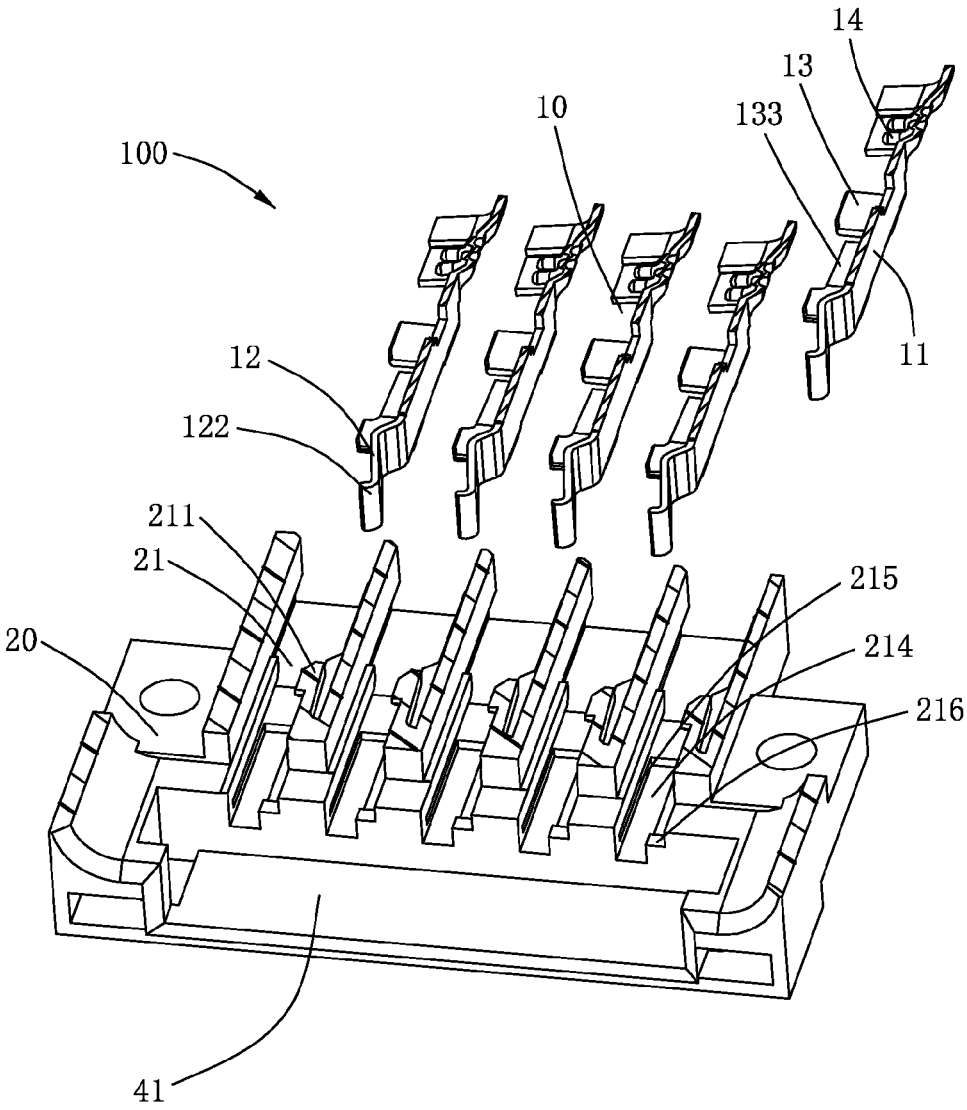
FIG. 5 is a partially exploded view of the power connector shown in FIG. 3.
Figure 6:
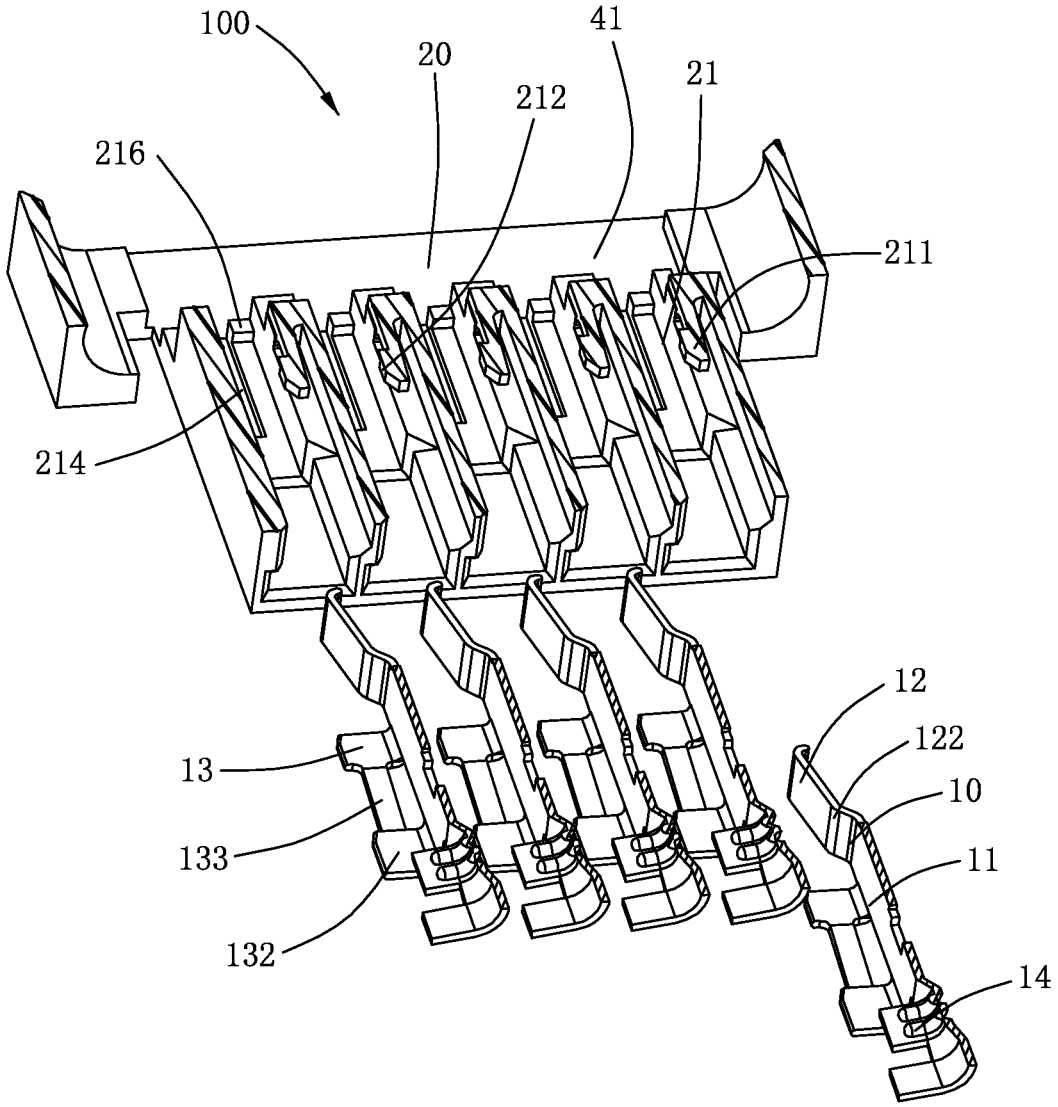
FIG. 6 is a view similar to FIG. 5 while taken from another aspect.

Referring to FIGS. 1-2, a power connector 100 in accordance with the present invention comprises a plurality of contacts 10 and an insulative housing 20 receiving the plurality of contacts 10. The power connector 100 is adapted for connecting with a cable (not shown).

The insulative housing 20 comprises a main body 30 and a mating tongue 40 extending forwardly from the main body 30. The mating tongue 40 defines a receiving space 41 for receiving a complementary connector (not shown) and a pair of guiding holes 42 at opposite sides of the receiving space 41 for guiding the insertion of a complementary connector (not shown). The receiving space 41 communicates with the guiding holes 42. In the present embodiment, the width of the main body 30 is smaller than that of the mating tongue 40. However, in other embodiments, the widths of the main body 30 and the mating tongue 40 can be changed according to different circumstances. A pair of fastening portions 43 is located at opposite sides of the main body 30 and adjacent to the mating tongue 40. The fastening portion 43 defines a through hole 44 for insertion therethrough a fastening element (not shown) to thereby secure the power connector 100 on an electrical device (not shown).

Referring to FIGS. 3-6, the main body 30 of the insulative housing 20 defines a plurality of passageways 21 extending along a longitudinal direction of the power connector 100. A separated wall 22 is formed between every two neighbored passageways 21. Each passageway 21 defines a latching arm 211, a latching recess 214 in a bottom face (not labeled), a guiding slit 215 and a projection 216 at entrance thereof. The latching arm 211 includes a protrusion 212 at a free end thereof and a step portion 213 connecting with the protrusion 212.

Figure 7:
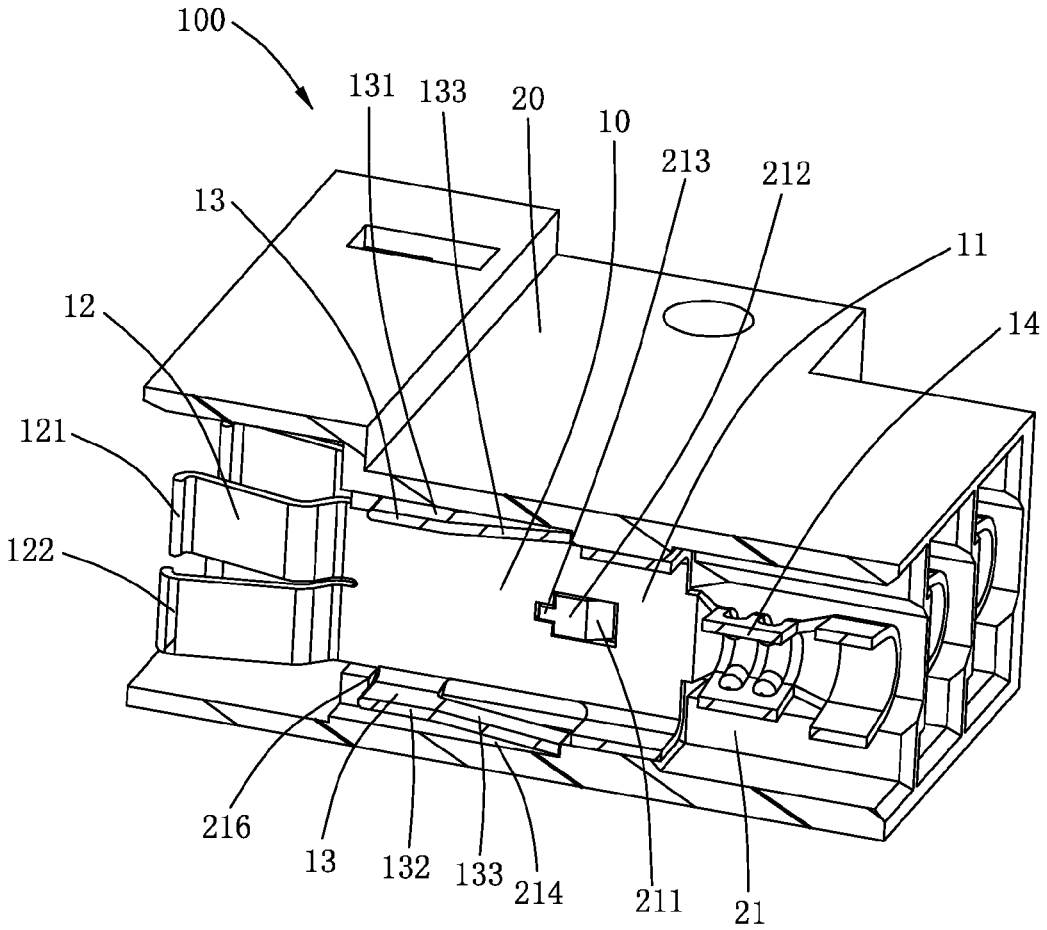
FIG. 7 is another cross-section view of the power connector.
Figure 8:
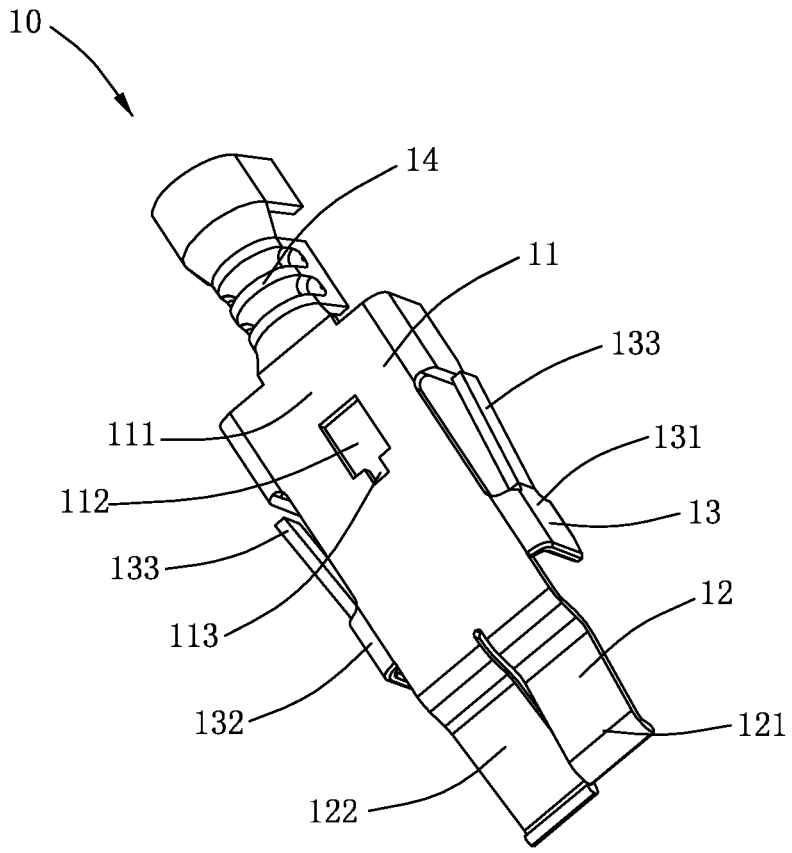
FIG. 8 is perspective view of a contact of the first embodiment.
Figure 9:
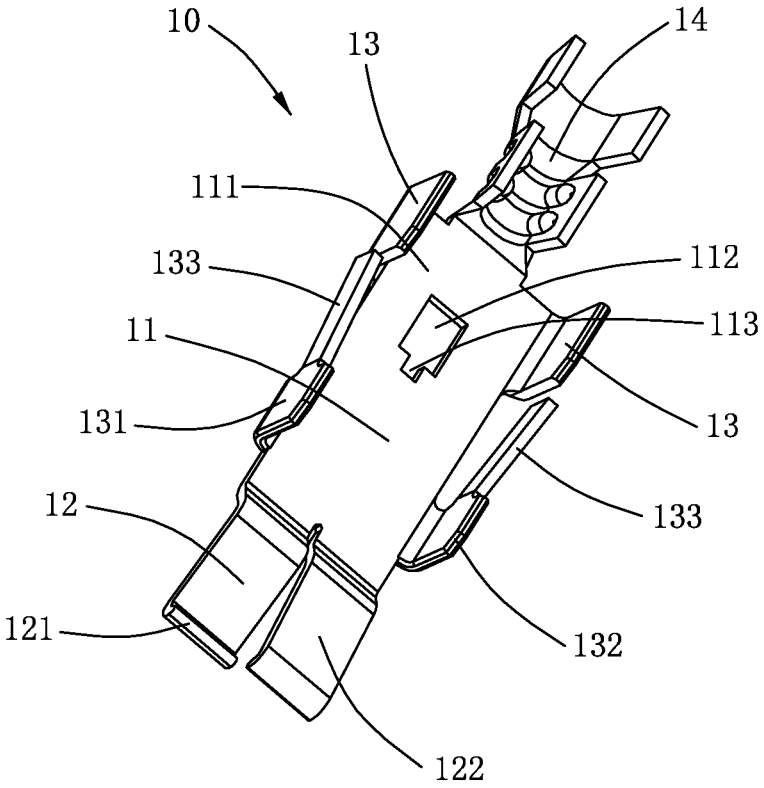
FIG. 9 is a view similar to FIG. 8 while taken from another aspect.

Referring to FIGS. 7-9, each contact 10 comprises a base section 11, a contact section 12 extending from a forward edge of the base section 11, a retention section 14 extending oppositely from a rear edge of the base section 11, and a side section 13 projecting perpendicularly from the base section 11. The base section 11 has a plane, bottom wall 111 which defines therethrough a rectangular, latching hole 112 and an end slot 113 communicating with the latching hole 112. The contact section 12 includes a pair of contact fingers 121, 122. The pair of contact fingers 121, 122 extends respectively slantedly from the forward edge of the bottom wall 111. The width of the two contact fingers 121, 122 is equal to that of the bottom wall 111. The side section 13 comprises a pair of side walls 131, 132 extending perpendicularly from the opposite side edges of the bottom wall 111 of the base section 11. Each side wall 131, 132 forms a beam 133 projecting rearwards and outwards. The retention section 14 is used to be electrically and mechanically connecting with the cable.

During assembly, the contacts 10 are inserted into the insulative housing 20 from a rear side of the housing 20. The protrusion 212 of the latching arm 211 is received in the latching hole 112 of the base section 11 of the contact 10. The step portion 213 of the latching arm 211 is engaged within the end slot 113 of the base section 11 of the contact 10. The side walls 131,132 are respectively guided and received in the guiding slit 215 of the passageway 21. The beam 133 of the side section 13 of the contact 10 is engaged within the latching recess 214 of the passageway 21 to thereby protect the contact 10 from moving outside of the passageway 21. A forward edge of the side walls 131, 132 abuts against the projection 216 in the passageway 21 for limit a displacement of the contact 10 along the longitudinal direction of the connector 100.

Figure 10:
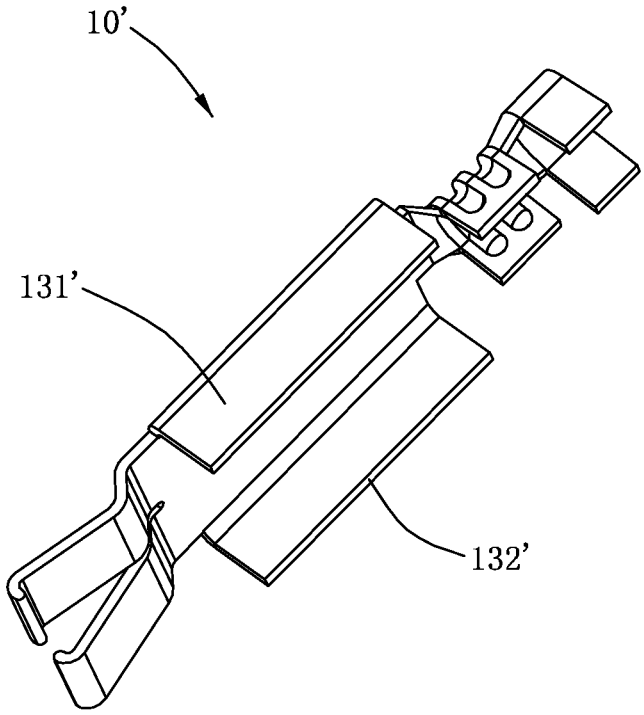
FIG. 10 is a perspective view of the contact in accordance with the second embodiment.
Figure 11:
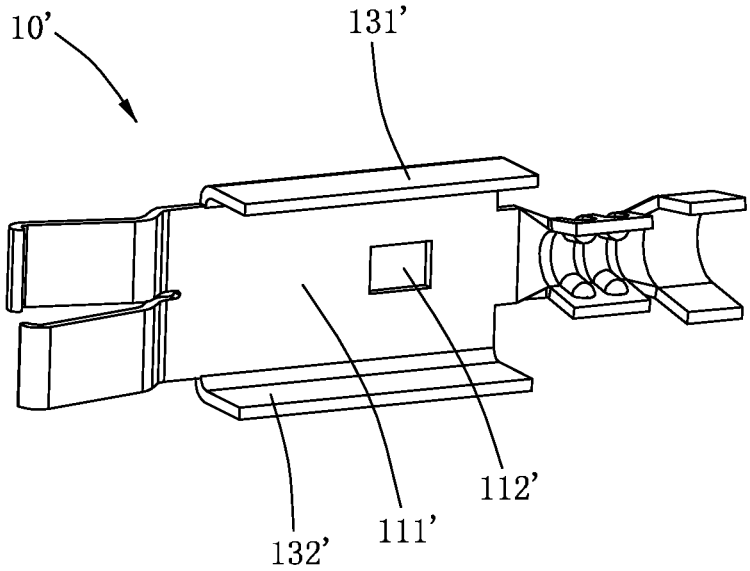
FIG. 11 is a view similar to FIG. 10 while taken from another aspect.

Referring to FIGS. 10-11, a contact 10' in accordance with a second embodiment is shown. The configuration of the contact 10' is similar to the configuration of the contact 10 of the first embodiment. Specially, a bottom wall 111' of the contact 10' of the second embodiment defines a latching hole 112' without the end slot as defined in the first embodiment. Besides, the contact 10' of the second embodiment forms a pair of side walls 131', 132' without a beam.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A power connector, adapted for electrically connecting with a cable, comprising:

an insulative housing defining a plurality of passageways extending therethrough, each of said plurality of passageways providing a latching arm formed therein, said insulative housing defining a latching recess recessed from an inside face of said passageway; and a plurality of contacts received in corresponding passageways, each contact having a base section, a contact section extending from said base section, a retention section extending oppositely from said base section, and a side section extending perpendicularly from edges of said base section, said side section having a first side wall and a second side wall, the first and the second side walls extending parallel from said base section between said contact section and said retention section; wherein said base section of said contact defines a latching hole receiving said latching arm of said insulative housing;

wherein at least one of said first and said second side walls forms a beam projecting outwardly therefrom;

wherein said beam of said contact is received in said latching recess to thereby prevent said contact from displacement along a contact insertion direction.

2. The power connector as claimed in claim 1, wherein said contact section of said contact comprises a pair of contact fingers, each of which extends slantedly from said base section.

3. The power connector as claimed in claim 1, wherein said latching arm forms a protrusion at a free end thereof.

4. The power connector as claimed in claim 3, wherein said base section of said contact defines a latching hole for receiving said protrusion to thereby secure the contact in said corresponding passageway.

5. The power connector as claimed in claim 4, wherein said latching arm forms a step portion connecting with said protrusion, and wherein said base section defines an end slot communicating with said latching hole for receiving said step portion.

6. The power connector as claimed in claim 1, wherein said insulative housing comprises a main body and a mating tongue extending from said main body.

7. The power connector as claimed in claim 6, wherein said mating tongue defines a receiving space communicating with said passageways defined in said main body with said contact sections of said contacts extending therein.

8. The power connector as claimed in claim 7, wherein said main body forms a projection projecting within said passageway and abutting against a forward edge of said side section of said contact.

9. The power connector as claimed in claim 7, wherein said passageways are positioned along a width direction of the power connector and wherein each of said passageway extends along a longitudinal direction of the power connector.

10. The power connector as claimed in claim 9, wherein said mating tongue defines a pair of guiding holes besides and communicating with said receiving space.

11. The power connector as claimed in claim 10, wherein said main body of said insulative housing comprises a pair of fastening portions at opposite sides thereof, and wherein said fastening portion defines a through hole extending therethrough.

12. The power connector as claimed in claim 11, further comprising a fastening element extending through said through hole of said fastening portion for securing said power connector.

13. A power connector, adapted for electrically connecting with a cable, comprising:

an insulative housing comprising a main body and a mating tongue extending from said main body, and defining a plurality of passageways extending therethrough, said mating tongue defining a receiving a space communicating with said passageways; and a plurality of contacts received in corresponding passageways, each contact having a base section, a contact section extending oppositely from said base section and extending within the receiving space, a retention section extending oppositely from said base section, and a side section extending perpendicularly from edges of said base section;

wherein said main body forms a projection projecting within said passageway and abutting against a forward edge of said side section of said contact;

wherein said contact section of said contact comprises a pair of contact fingers, each of which extends slantedly from said base section.

14. A power connector, adapted for electrically connecting with a cable, comprising:

an insulative housing comprising a main body and a mating tongue extending from said main body, and defining a plurality of passageways extending therethrough, said mating tongue defining a receiving space communicating with said passageways; and a plurality of contacts received in corresponding passageways, each contact having a base section, a contact section extending from said base section and extending within the receiving space, a retention section extending oppositely from said base section, and a side section extending perpendicularly from edges of said base section;

wherein said main body forms a projection projecting within said passageway and abutting against a forward edge of said side section of said contact;

wherein each of said plurality of passageways provides a latching arm formed therein.

15. The power connector as claimed in claim 14, wherein said base section of said contact defines a latching hole receiving said latching arm of said insulative housing.

* * * * *